US007641508B2

(12) United States Patent
Chen et al.

(10) Patent No.: US 7,641,508 B2
(45) Date of Patent: Jan. 5, 2010

(54) BATTERY CONNECTOR WITH REINFORCING MEMBERS

(75) Inventors: De-Jin Chen, ShenZhen (CN); Yu-San Hsiao, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/217,188

(22) Filed: Jul. 1, 2008

(65) Prior Publication Data

US 2009/0017674 A1 Jan. 15, 2009

(30) Foreign Application Priority Data

Jul. 10, 2007 (CN) ..... 200720040639.8

(51) Int. Cl.
*H01R 3/00* (2006.01)

(52) U.S. Cl. ..... 439/500

(58) Field of Classification Search ..... 439/500, 439/341, 376, 326
See application file for complete search history.

(56) References Cited

U.S. PATENT DOCUMENTS

2004/0137786 A1* 7/2004 Yu ..... 439/500
2007/0281540 A1 12/2007 Liao
2008/0268701 A1* 10/2008 Yuan et al. ..... 439/500
2009/0148757 A1* 6/2009 Zhang et al. ..... 429/100
2009/0156052 A1* 6/2009 Chen ..... 439/500

FOREIGN PATENT DOCUMENTS

TW 255550 8/1995

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

A battery connector (1) comprises a dielectric housing (2) and a first conductive contact (4). The dielectric housing (2) comprises a cylindrical receiving cavity, a base (20), holding means (24) formed toward an upper section of the receiving cavity for engaging with the top face of the accommodated battery (5) to prevent the battery (5) from coming off, and a pair of spring strengtheners (22) extending upwardly from said base (20) for abutting a bottom face of the accommodated battery (5). The first conductive contact (4) comprises a first retaining section (40) secured in said dielectric housing (2) at a peripheral area of said base (20), a spring arm (42) inclining upwardly from said retaining section (40). The spring arm (42) extends between said pair of spring strengtheners (22), and the distal end of said spring arm (42) is free.

2 Claims, 5 Drawing Sheets

BATTERY CONNECTOR WITH REINFORCING MEMBERS

BACKGROUND OF THE INVENTION

1. Field of the invention

The present invention is generally related to the art of battery connector, and especially, to a button cell battery connector which includes reinforcing members for strengthening the retention of the battery in the battery connector.

2. Description of Related Art

A button cell battery is usually used in an electrical apparatus, for example a computer, provided as an auxiliary power source. This battery comprises a cathode on a lower face and an anode on an upper face and a peripheral face.

A battery connector is usually provided on a mother board to mount the battery therein to establish an electrical connection between the battery and the mother board. An example of battery connector can be seen in U.S. patent application publication No. 2007/0281540 A1 published on Dec. 6, 2007.

The battery connector comprises a dielectric housing defining a receiving cavity for retaining the battery therein, anode and cathode contacts respectively secured on the dielectric housing and electrically connected with the mother board. The anode contact is disposed on a side wall of the receiving cavity and can elastically move along a lateral direction while the cathode contact is disposed on a bottom of the receiving cavity and can elastically move along the vertical direction. The button cell battery is usually small, and in order to meet a low profile feature of the electrical apparatus using battery, the battery connector can't be made too high. The space in the connector is narrow, which makes the spring section of the contact often short and can't give enough force to hold a mounted battery in certain position.

Hence, an improved battery connector is required to overcome the disadvantages of the prior art.

SUMMARY OF THE INVENTION

Accordingly, an object of the present invention is to provide a battery connector for mounting a button cell battery.

In order to achieve the above-mentioned object, a battery connector comprises a dielectric housing and a first conductive contact. The dielectric housing comprises a receiving cavity suitable for accommodating a cylindrical battery therein, a base suitable for facing a bottom face of the accommodated battery, holding means formed toward an upper section of the receiving cavity for engaging with a top face of the accommodated battery to prevent the battery from coming off, and a pair of spring strengtheners extending upwardly from said base for abutting a bottom face of the accommodated battery. The first conductive contact comprises a retaining section secured in said dielectric housing at a peripheral area of said bottom plate, and a spring arm inclining upwardly from said retaining section, wherein said spring arm extends between said pair of spring strengtheners, and a distal end of said spring arm is free.

When a battery mounted, the free end of the spring arm and the free ends of the pair of spring strengtheners engage the bottom face of the battery, the spring arm and the pair of spring strengtheners are all elastically deformed, they corporately exert strength against the bottom of the battery, the battery is stably held in place.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
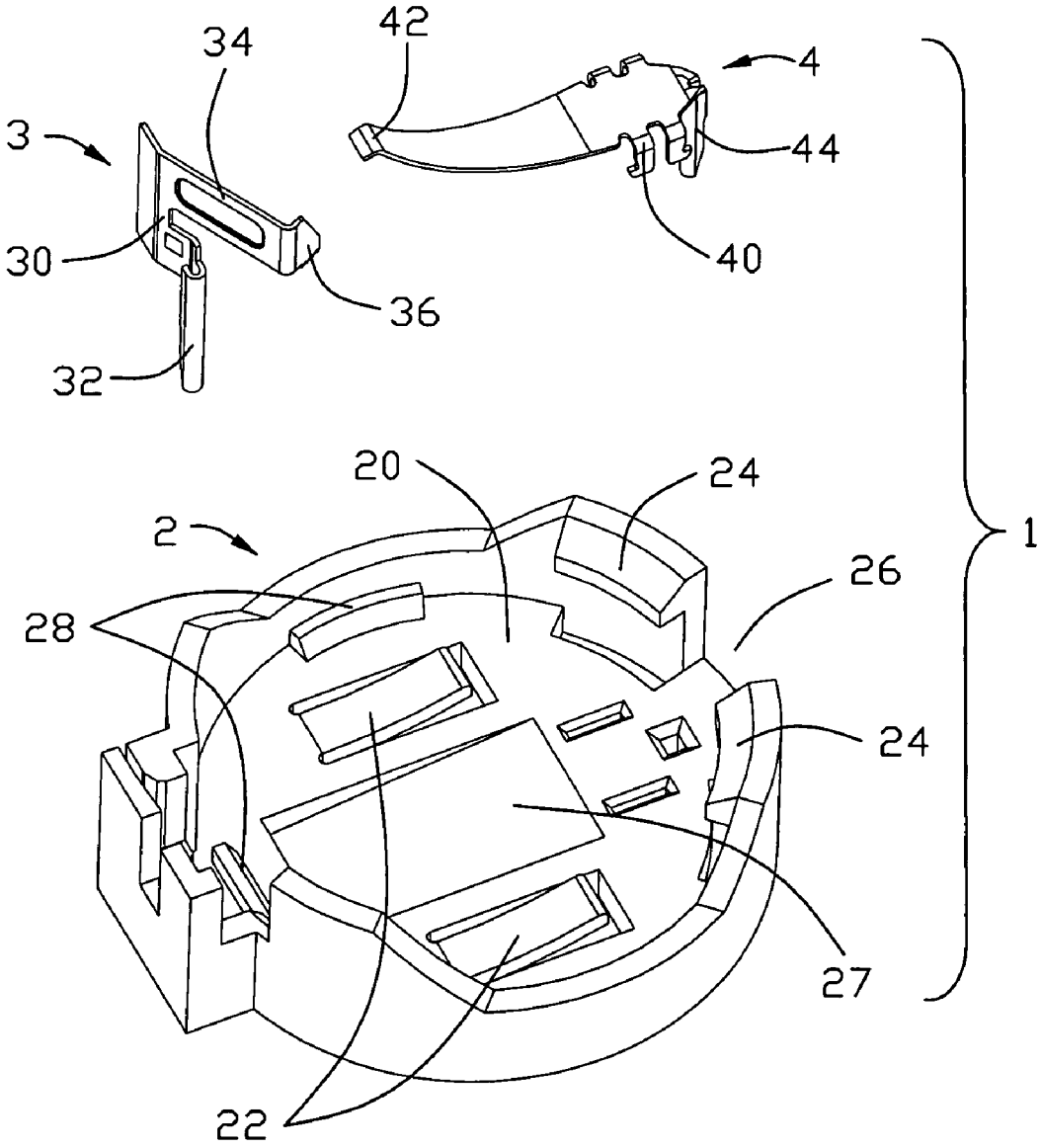
FIG. 1 is an exploded, perspective view of a battery connector of a preferred embodiment of the present invention.
Figure 2:
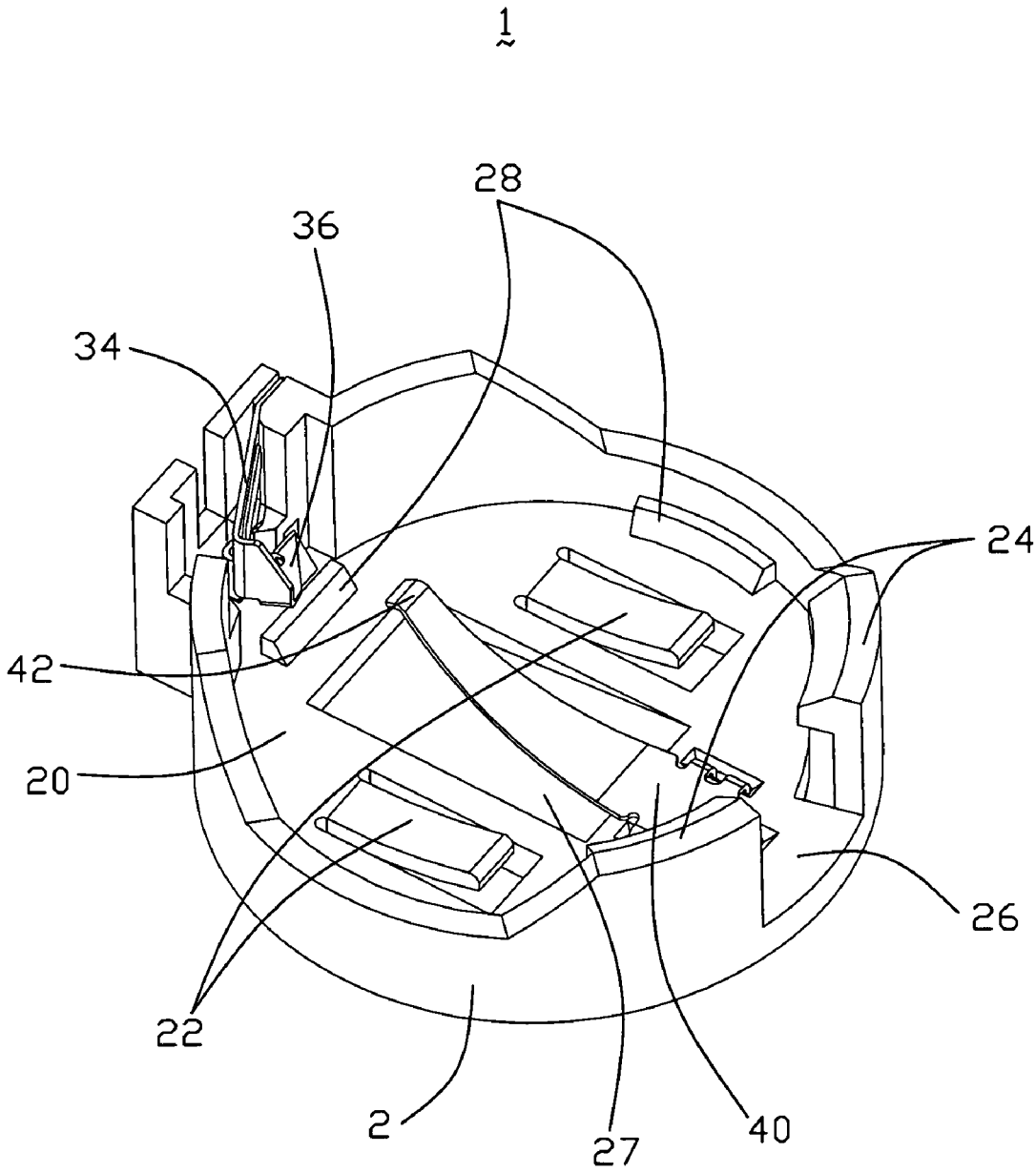
FIG. 2 is an assembled, perspective view of the battery connector as shown in FIG. 1.
Figure 3:
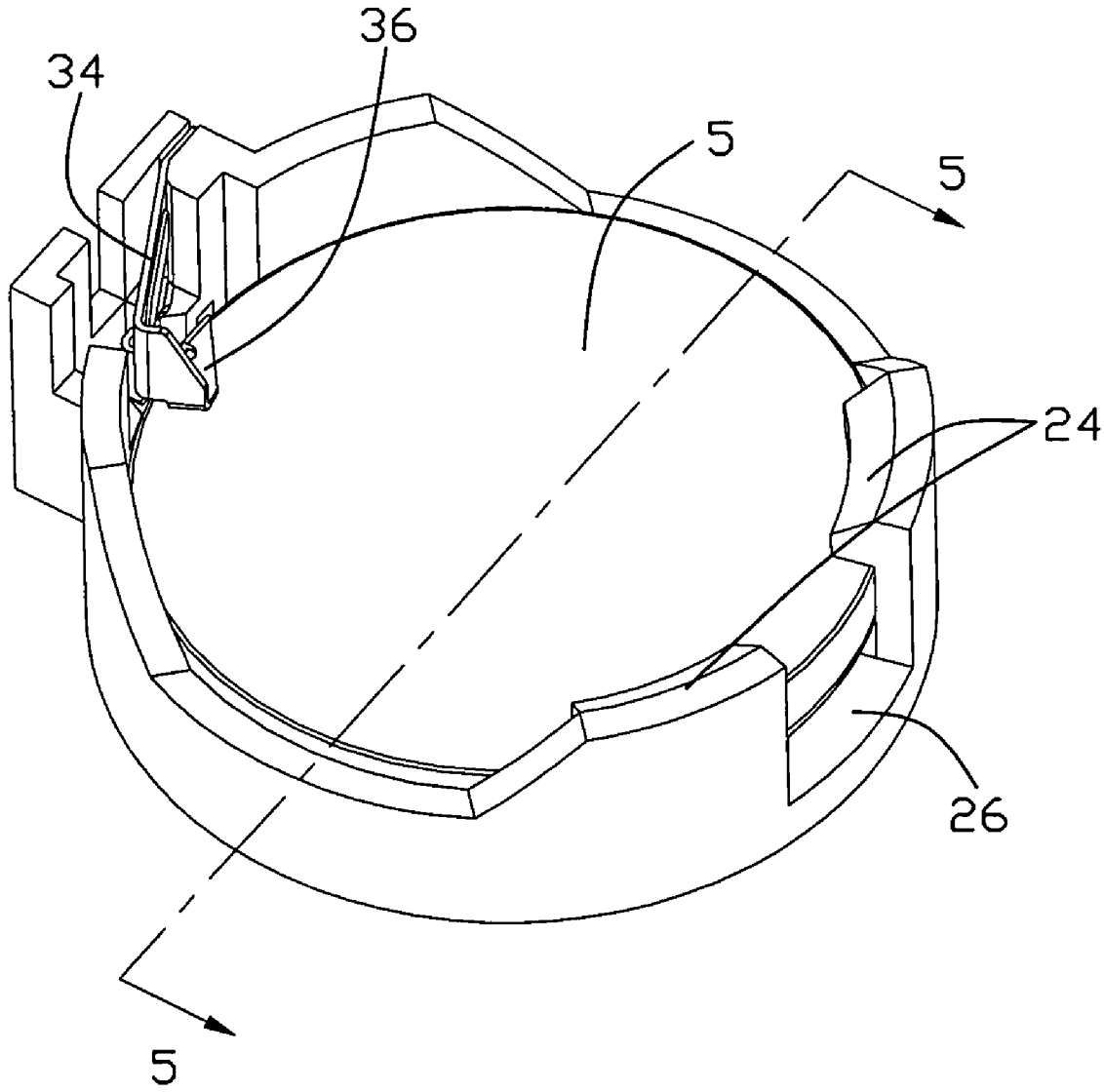
FIG. 3 is perspective view illustrating the battery connector accommodating a battery therein.
Figure 4:
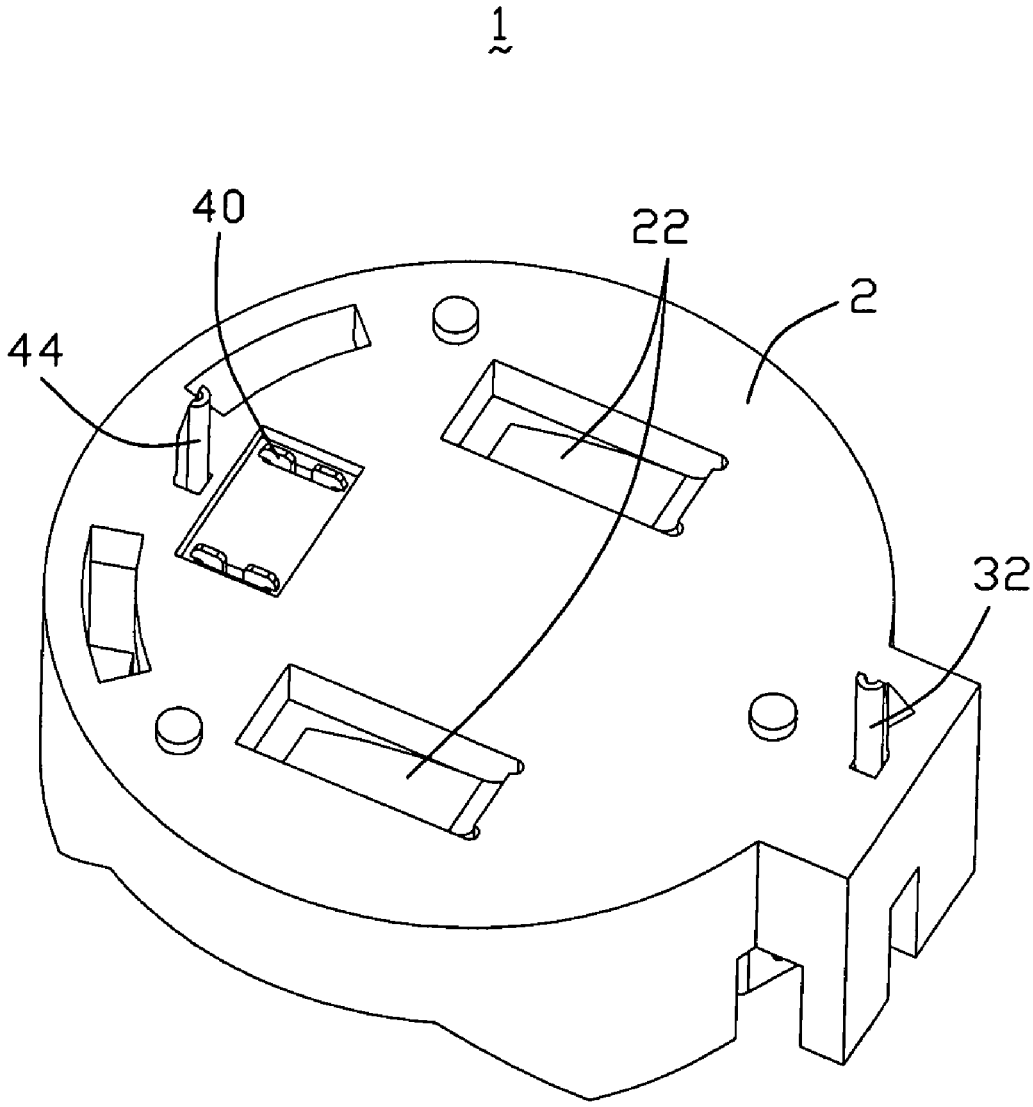
FIG. 4 is another perspective view of the battery connector as shown in FIG. 2.
Figure 5:
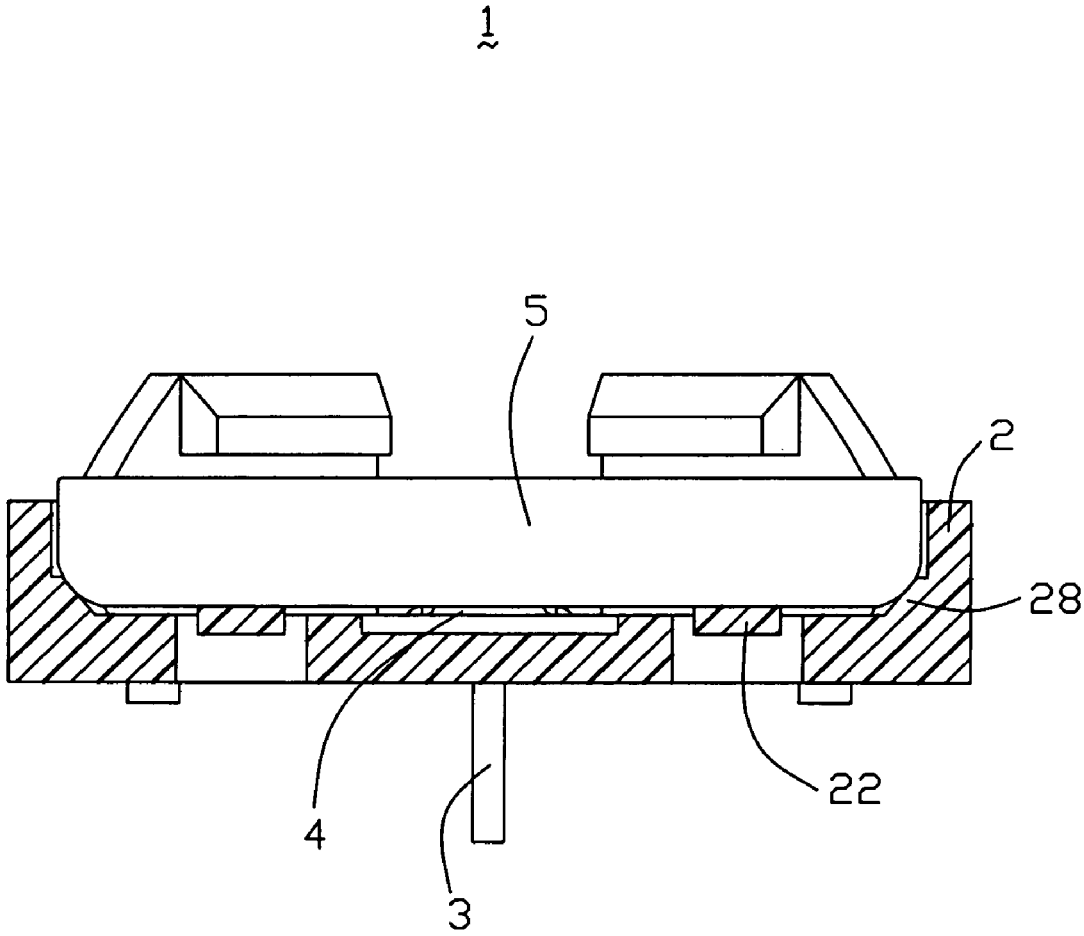
FIG. 5 is cross section view of the battery connector accommodating a battery therein as shown in FIG. 3, along the 5-5 line.

Referring to FIGS. 1-5, a battery connector 1 comprises a dielectric housing 2, a first conductive contact 4 and a second conductive contact 3.

The dielectric housing 2 comprises a cylindrical receiving cavity (not labeled) suitable for accommodating a battery 5 therein, a base 20 suitable for facing a bottom face of the accommodated battery 5, holding means 24 formed toward an upper section of the receiving cavity (not labeled) for engaging with the top face of the accommodated battery 5 to prevent the battery 5 from coming off, and a pair of spring strengtheners 22 extending upwardly from said base 20 for abutting the bottom face of the accommodated battery 5. According to the embodiment, the holding means 24 are a pair of protruding bars 24 on a side wall. The dielectric housing 2 further defines a cutout 26 between said pair of protruding bars 24 allowing a tool to eject an accommodating battery 5 out.

The first conductive contact 4 comprising a first retaining section 40 secured in said dielectric housing 2 at a peripheral area of said base 20, a spring arm 42 inclining upwardly from said retaining section 40, and a soldering section 44 extending downwardly for an edge of the retaining section 40 opposite to the spring arm 42. Wherein the spring arm 42, from a top view thereof, extends between the pair of spring strengtheners 22 in a direction opposite to said pair of spring strengtheners 22, and the distal end of said spring arm 42 is free.

The second conductive contact 3 secured on a side wall (not labeled) of said receiving cavity (not labeled) opposite to the pair of protruding bars 24. The second conductive contact 3 comprises a second retaining section 30 secured in the dielectric housing 2, a holding section 36 for engaging with the top face of a accommodated battery 5, an elastic connecting section 34 extending between said second retaining section 30 and said holding section 36, and a second soldering section 32 extending downwardly from the second retaining section 30.

The dielectric housing 2 further defines three supporting protrusions 28 on the peripheral area of said base 20, wherein a pair of protrusions 28 respectively stand on areas adjacent said pair of spring strengtheners, and a protrusion 28 stands on a area adjacent the second conductive contact 3. The three supporting protrusions 28 can support the peripheral edge of a mounted battery 5 to protect the spring arm 42 from permanent deformation and to prevent a battery 5 from being mounted inversely. The base 20 defines a recess 27 right below the spring arm 42 of the first conductive contact 4, the recess 27 has a shape such that the further the recess leaves away from the retaining section 40 the deeper it will be, it can contain the spring arm 42 therein and protects the spring arm 42 from permanent deformation when the spring arm 42 is deformed.

When a battery 5 mounted, the free end of the spring arm 46 engages the bottom face of the battery 5, the spring arm 42 is elastically deformed, then the free ends of the pair of spring strengtheners 22 engage the bottom face of the battery, the spring arm 42 and the pair of spring strengtheners 22 are all elastically deformed, they corporately exert strength against the bottom of the battery 5, the battery 5 is stably held in place.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A battery connector comprising:

a dielectric housing comprising a receiving cavity suitable for accommodating a cylindrical battery therein, a base suitable for facing a bottom face of the accommodated battery, holding means formed toward an upper section of the receiving cavity for engaging with a top face of the accommodated battery to prevent the battery from coming off, and a pair of spring strengtheners extending upwardly from said base for abutting a bottom face of the accommodated battery; and a first conductive contact comprising a retaining section secured in said dielectric housing at a peripheral area of said bottom plate, and a spring arm inclining upwardly from said retaining section, wherein said spring arm extends between said pair of spring strengtheners, and a distal end of said spring arm is free, wherein said base has a portion, shaped as said pair of spring strengtheners, integrally extending therefrom, said spring arm, from a top view thereof, extends in a direction opposite to that of said pair spring strengtheners, wherein said receiving cavity of the dielectric housing is cylindrical, said battery connector further comprises a second conductive contact secured on a side wall of said receiving cavity, wherein said second conductive contact comprises a second retaining section secured on the side wall of said receiving cavity, an holding section for engaging with the top face of a accommodated battery, and an elastic connecting section extending between said second retaining section and said holding section, wherein said holding means of said dielectric housing comprises a pair of protruding bars on a side wall opposite to the second conductive contact, said dielectric housing further defines a cutout between said pair of protruding bars allowing a tool to eject an accommodated battery out, wherein said dielectric housing further defines supporting protrusions on the peripheral area of said bottom plate, wherein said supporting protrusions comprises at least three, wherein a pair of protrusions respectively stand on areas adjacent said pair of spring strengtheners, and a protrusion stands on a area adjacent the second conductive contact, wherein said dielectric housing further defines a recess below said spring arm of the first conductive contact and can accommodate the spring arm therein.

2. A battery connector comprising:

a dielectric housing comprising a receiving cavity suitable for accommodating a cylindrical battery therein, a base suitable for facing a bottom face of the accommodated battery, holding means formed toward an upper section of the receiving cavity for engaging with a top face of the accommodated battery to prevent the battery from coming off, and at least one spring strengthener integrally extending upwardly from said base for abutting a bottom face of the accommodated battery; and a first conductive contact comprising a retaining section secured in said dielectric housing at a peripheral area of said bottom plate, and a spring arm inclining upwardly from said retaining section, wherein a distal end of said spring arm is free, from a top view, said spring arm extends in a direction opposite to that of said at least one spring strengthener, wherein said receiving cavity of the dielectric housing is cylindrical, said battery connector further comprises a second conductive contact secured on a side wall of said receiving cavity, wherein said second conductive contact comprises a second retaining section secured on the side wall of said receiving cavity, an holding section for engaging with the top face of a accommodated battery, and an elastic connecting section extending between said second retaining section and said holding section, wherein said holding means of said dielectric housing comprises a pair of protruding bars on a side wall opposite to the second conductive contact, said dielectric housing further defines a cutout between said pair of protruding bars allowing a tool to eject an accommodated battery out, wherein said dielectric housing further defines supporting protrusions on the peripheral area of said bottom plate, said supporting protrusions comprises at least three, wherein a pair of protrusions respectively stand on areas adjacent said pair of spring strengtheners, and a protrusion stands on a area adjacent the second conductive contact, wherein said dielectric housing further defines a recess below said spring arm of the first conductive contact and can accommodate the spring arm therein.

* * * * *